United States Patent [19]

Dremann et al.

[11] Patent Number: 4,568,388

[45] Date of Patent: Feb. 4, 1986

[54] MAGNESIUM-TITANIUM-FERROSILICON ALLOYS FOR PRODUCING COMPACTED GRAPHITE IRON IN THE MOLD AND PROCESS USING SAME

[75] Inventors: Charles E. Dremann, Phoenixville, Pa.; Thomas F. Fugiel, Arlington Heights, Ill.

[73] Assignee: Foote Mineral Company, Exton, Pa.

[21] Appl. No.: 700,796

[22] Filed: Feb. 11, 1985

[51] Int. Cl.[4] ..... C22C 33/08

[52] U.S. Cl. ..... 75/130 A; 53/130 R; 420/578; 420/581

[58] Field of Search ..... 75/53, 130 R, 130 A, 75/130 B, 130 C; 420/578, 581

[56] References Cited

U.S. PATENT DOCUMENTS 4,036,641 7/1977 Evans et al. .
4,086,086 4/1978 Dawson et al. .

FOREIGN PATENT DOCUMENTS 0020819 12/1979 European Pat. Off. .
0067500 12/1982 European Pat. Off. .
1559168 1/1980 United Kingdom .

OTHER PUBLICATIONS

Foote Mineral Company, Exton, PA, Technical Data Bulletin 243-C, Nov. 1982.

*Primary Examiner*—Peter D. Rosenberg
*Attorney, Agent, or Firm*—Howson and Howson

[57] ABSTRACT

Compacted graphite (CG) cast iron is obtained in the inmold casting process employing as an additive an alloy comprising 1.5–3 percent magnesium, 10–20 percent titanium, 40–80 percent silicon, 0–2 percent rare earth, 0–0.5 percent calcium, 0–2 percent aluminum and balance iron.

4 Claims, No Drawings

MAGNESIUM-TITANIUM-FERROSILICON ALLOYS FOR PRODUCING COMPACTED GRAPHITE IRON IN THE MOLD AND PROCESS USING SAME

This invention relates to novel magnesium-titanium-ferrosilicon-containing alloys for producing compacted graphite (CG) iron in the mold and to a casting process using such alloys.

BACKGROUND OF THE INVENTION

Compacted graphite is the name usually given to flake graphite which has become rounded, thickened and shortened as compared to normal elongated flakes commonly found in gray cast iron. This modified form of graphite has also been known by various other names, such as "vermicular", "quasi-flake", "aggregate flake", "chunky", "stubby", "up-grade", "semi-nodular" and "floccular" graphite.

Most cast irons have elongated flake graphite structures and such irons are comparatively weak and brittle, but have good thermal conductivity and resistance to thermal shock. It is also possible to produce cast irons having a nodular graphite structure and these are ductile and comparatively strong, but they have lower thermal conductivity and in some instances poorer resistance to thermal shock than gray iron. Advantageously, irons with compacted graphite structures combine the high strength and ductility of nodular graphite irons with good thermal conductivity and resistance to thermal shock evidenced by gray iron.

U.S. Pat. No. 4,036,641 discloses a method for treating molten carbon-containing iron to produce a cast iron with compacted graphite structure comprising adding to the molten iron in a single step an alloy containing silicon, magnesium, titanium and a rare earth, the balance being iron. The alloy contains a minimum of 3 percent magnesium and the ratio of titanium to magnesium is in the range of 1:1 to 2:1.

U.S. Pat. No. 4,086,086 is directed to an improvement in the alloy and method of U.S. Pat. No. 4,036,641 in that there is included in the alloy 2 to 10 percent of calcium. The presence of this element is said to produce compacted graphite cast irons with a wider range of initial sulfur contents.

For some years the "inmold" process has been used successfully for production of ductile iron. In such process untreated molten gray iron is introduced into the mold cavity by way of a conventional pouring system which additionally includes one or more intermediate chambers containing a nodularizing agent in an amount sufficient to convert the graphite to nodular or spheroidal form.

British Pat. No. 1,559,168 relates to a modification of such inmold process wherein, instead of the product being nodular or spheroidal graphite iron castings, the product is cast iron with compacted graphite. The agent for providing the iron with compacted graphite is a 5 percent magnesium ferrosilicon alloy containing cerium. Such agent or alloy may, in addition to containing 5 percent magnesium, contain 0.3 to 0.5 percent calcium, 0.2 percent cerium, 45 to 50 percent silicon and balance iron. Titanium may be added separately to the metal in the ladle before being cast or included in the alloy. The patent also sets forth process parameters, including the base area of the intermediate chamber, to obtain a given magnesium content in the cast metal.

European patent application No. 0 067 500, published Dec. 22, 1982, is directed to inmold treatment of molten iron to produce on a relatively consistant basis castings containing 30 to 70 percent nodular graphite and balance compacted graphite. The addition may comprise a free-flowing combination of about 6 percent magnesium and balance ferrosilicon (50 percent). The addition may also be in the form of preforms of agglomerated particles, cast solid preforms, or particles suspended in a resinous binder. The addition does not include titanium except in noneffective trace amounts, since this "deleterious" element is said to inhibit nodularity.

European patent application No. 0 020 819 published Jan. 7, 1981 is directed to a process for making compacted graphite cast iron using an addition having a fine sieve analysis (1–3 mm particles). The composition of the addition is not given. Rather the application indicates that the composition of the addition is known and comprises silicon, magnesium, titanium, calcium and rare earth metals. The addition is believed to be that of U.S. Pat. No. 4,036,641 (supra).

Since about 1976, Foote Mineral Company, Exton, Pa., has sold alloys designed for producing compacted graphite iron. Although such alloys vary somewhat in composition, they all contain on the order of at least about 2.8 magnesium, with some containing 4.5 to 5.5 percent magnesium, and a maximum of about 10 percent titanium. In such alloys the ratio of titanium to magnesium is quite low not exceeding about 3.6:1, and for several of the alloys the ratio is on the order of 1.3:1 to 2.5:1, depending on the particular alloy. In advertising literature pertaining to these commercially available alloys, one alloy containing 2.8 to 3.3 percent magnesium and 8 to 10 percent titanium, and having a Ti/Mg ratio of about 3:1, is indicated as having utility in the inmold process.

Rather extensive tests of various of these prior known alloys have failed to result in the production of compacted graphite iron when used in the inmold process. On occasion compacted graphite iron was obtained in parts of castings or in a mold, but this type of iron could not be consistently obtained over a wide range of conditions. Thus, such alloys are inadequate for use in the inmold process.

OBJECTS OF THE INVENTION

An object of this invention is to provide a novel alloy for inmold casting of compacted graphite iron, which alloy dissolves at a rapid rate at standard inmold casting temperatures.

Another object of the invention is to provide an alloy for inmold casting of compacted graphite iron, which alloy produces CG iron on a consistent basis.

Another object of the invention is to provide an alloy for inmold casting of compacted graphite iron, which alloy can be used in the same inmold chamber as alloys designed to produce nodular cast iron.

Still a further object of this invention is a novel inmold method for producing compacted graphite cast iron.

These and other objects of this invention will become further apparent from the following description of preferred embodiments of the invention, and appended claims.

BRIEF DESCRIPTION OF THE INVENTION

In accordance with the invention there is provided a novel alloy for inmold manufacture of compacted graphite cast iron containing as essential elements magnesium, titanium, silicon and iron in specified proportions, especially as regards the amount of magnesium and titanium, and the weight ratio of one to the other. The alloy may also contain small amounts of rare earths, calcium and aluminum. The presence of calcium is undesirable and thus the calcium content is purposely limited.

It was discovered that such alloy can be used successfully in the inmold process for producing compacted graphite cast iron. The alloy dissolves at a reasonably rapid rate and produces compacted graphite iron over a wide range of process variables. In addition, it was discovered that the new alloy will produce compacted graphite iron in the inmold process using the same inmold chamber designed to contain an alloy for producing ductile iron. Thus, a casting can be made of either compacted graphite iron or ductile iron merely by selecting the alloy placed in the chamber.

DETAILED DESCRIPTION OF THE INVENTION

The alloys of this invention have the composition set forth in Table I, below:

TABLE I

| Constituent | Weight Percent | |
|---|---|---|
| | Generally | Preferred |
| Magnesium | 1.5–3.0 | 1.75–2.25 |
| Titanium | 10–20 | 14–16 |
| Rare earths | 0–2 | 0.1–0.5 |
| Calcium | 0–0.5 | less than 0.2 |
| Aluminum | 0–2 | 0.4 |
| Silicon | 40–80 | 50 |
| Iron | Balance | Balance |

Preferably the rare earth is predominantly cerium or lanthanum.

Of particular importance are not only the amounts of magnesium and titanium present in the alloy, but the weight ratio of the latter to the former. It was discovered that if compacted graphite iron is to be produced consistently the weight ratio of titanium to magnesium should be in the range of about 4:1 to about 12:1, preferably about 7.5:1.

In the alloys of the invention, the titanium functions as a denodulizer in the presence of magnesium and thereby enhances formation of compacted graphite iron.

The alloy is fast dissolving which is important for successful use in the inmold process for producing compacted graphite cast iron. Dissolution rate increases with increases in the content of both magnesium and titanium. Thus, since the alloy contains only a relatively small amount of magnesium, i.e. a maximum of about 3.0 percent, in the alloy the titanium to magnesium is relativly high, i.e. at least about 4:1 and preferably about 7.5:1, to maintain an adequate dissolution rate.

The silicon content also is important to dissolution rate for as the content thereof is increased dissolution rate increases.

The calcium content is important to dissolution rate for as the content thereof is increased dissolution rate decreases. Calcium, therefore, is undesirable. Low calcium also promotes the compacted form of graphite over the nodular or flake form of graphite. For these reasons, the calcium content is limited as much as is practical for manufacturing techniques.

Cerium and other rare earths give protection against deleterious impurities occasionally found in cast iron. Higher cerium contents tend to help reduce the undesriable effects of higher calcium content.

The low aluminum contents generally present in these alloys appear to have little influence on dissolution rate or in forming the compacted graphite structure.

The alloys of this invention may be prepared by plunging magnesium, titanium and rare earth into molten ferrosilicon alloy. The alloys are relatively simple to manufacture using such procedure, and if a ferrosilicon alloy of high silicon content is used, the violence of the reaction is reduced.

The ferrosilicon alloy in which magnesium and titanium metal are plunged can be prepared by standard smelting techniques well known in the metallurgical art and need no particular description here. In the alloy calcium and aluminum are usually present as impurities. The calcium content may be kept low by selection of quartzite and coals with low calcium contents. Calcium may also be removed from the molten ferrosilicon by chlorination or oxidation.

The alloy can also be prepared by smelting quartzite, steel scrap and a titanium ore to form ferrosilicon titanium, to which a rare earth silicide, magnesium, and additional titanium, if necessary, may be added.

The alloy may also be made by melting pure metals such as silicon, iron, titanium, cerium and magnesium.

In order to obtain the desired rate of dissolution of the alloy in the molten iron, the particle size of the alloy should be such that substantially all particles pass through a 5 mesh screen and are retained on a 18 mesh screen. Coaser or finer sizes, however, may be used as long as the dissolution rate is determined and the mold geometry adjusted for the change in dissolution.

Using the alloy of this invention in the inmold production of compacted graphite cast iron in the amounts hereinafter discussed, ordinarily the iron, in thicker sections of castings, e.g. those having a thickness of at least 0.5 in., will have a nodularity not exceeding about 20 percent and a complete absence of gray iron. However, in thin sections of castings such as those 0.25 in. and thinner, the nodularity may run as high as about 30 percent. However, such degree of nodularity is acceptable in most castings where compacted graphite iron is sought. Although the form of carbon in an iron casting is best determined by metallographic examination, a useful determination can be made by means of ultrasonic velocity.

The boundry between ductile iron and gray iron is relatively narrow and, in terms of ultrasonic velocity, the area of compacted graphite cast iron generally falls within the range of from about 0.1950 in/μsec. to about 0.2120 in/μsec. Ultrasonic velocity values below about 0.1950 in/μsec. indicate gray iron was cast, whereas at values above about 0.2120 in/μsec., nodular graphite cast iron is the predominant form. A compacted graphite cast iron containing 20 percent or less nodularity is generally obained with an ultrasonic velocity in the range of about 0.2050 to 0.2120 in/μsec. These figures are subject to the calibration of the unit being used.

By reason of the relatively narrow boundry between gray iron and ductile iron, care must be taken to introduce to the molten iron a proper amount of the alloy of this invention. Generally, in order to obtain compacted graphite cast iron, the amount of alloy used should be such as to provide the iron with from about 0.010 to about 0.025 percent, by weight, of residual magnesium, and from about 0.10 to about 0.15 percent of residual titanium. Higher titanium along with higher magnesium contents also provide the compacted graphite stucture. Such values can be obtained in the inmold process using the alloy of this invention, provided the chamber containing the alloy has the proper size and the proper quantity of alloy is placed in the chamber. Of course, the gating system is important as in any casting process and should be such as to enable rapid dissolution of the alloy in the molten iron during the entire pour. Advantageously, the alloy of the present invention can be used in reaction chambers of a size and configuration designed for the production of ductile iron.

In order to determine reaction chamber dimensions to obtain the desired residual magnesium in the cast iron for production of compacted graphite cast iron, metal pouring rate as well as total concentration of magnesium in the cast metal, expressed as proportion of the weight of the cast metal, should be selected.

The weight of the alloy required is equal to the magnesium concentration desired in the iron times the poured weight of iron divided by the concentration of magnesium in the alloy. The volume for this weight of alloy is determined from the density of the alloy. The dissolution rate of the alloy is determined by observation using a window in the side of a test mold. Once this dissolution rate is determined (for example in inches/-second), the depth of the alloy chamber is matched to the pouring time of the casting mold. The cross sectional area of the chamber would be the volume of the alloy divided by the depth of the chamber.

Casting temperatures ordinarily will be in the range of about 2400° to 2800° F. (1316° to 1538° C.). At these temperatures, the iron retains good fluidity in a room temperature mold.

This invention will be better understood by a consideration of the following examples which are presented by way of illustration and not by way of limitation.

EXAMPLE I

Eight alloys were prepared by plunging magnesium into molten ferrosilicon titanium which also contained small amounts of aluminum, calcium, and rare earths in the amount to provide the compositions given in Table II below.

One hundred pounds of molten iron containing 3.7% C, 2.0% Si, 0.3% Mn, and 0.015% S was prepared by induction furnace melting. The molten iron was poured into a mold having a gating system which included an intermediate chamber provided with a fused silica window. The molten iron at 2550° F. (1400° C.) introduced to the gating system was permitted to exit the mold and samples were caught in separate molds and the cast metal was subjected to metallographic studies to determine the form of the carbon present. The quantity of the alloy placed in the intermediate reaction chamber in each test is set forth in Table II, as are the results of the metallographic studies. The particle size of the alloys was such that all particles passed through a 5 mesh screen but were retained on an 18 mesh screen.

Moving pictures were taken of the fused silica window on the side of the reaction chamber employing a camera fitted with an 8:1 telephoto lens. Wide angle pictures were also taken on the overall apparatus, which included the mold, pouring ladle, molten metal collector and a clock. The pictures obtained enabled determination of the dissolution time. The results are given in Table II.

Tests 1–4 in Table II show the advantageous results obtainable using this invention. The structure of the iron produced is predominantly compacted graphite and no gray is present.

Tests 5 and 6 show the influence of higher calcium contents. The dissolution of the alloy is very slow and after the first metal passes throught the chamber the remaining iron is gray.

Tests 7 and 11 show that too much magnesium and not enough titanium cause the graphite in the iron to be nodular. 110 cc is the proper chamber size for nodular iron using alloys suitable for nodulizing. In tests 8, 9 10, 12, 13 and 14, the depth of the intermediate chamber remained the same but the cross sectional area of the chamber was reduced so that less magnesium was added to the molten iron. For the alloy in tests 7–10, no cross sectional area gave acceptable results. Tests 12 and 13 gave results which are good for the second and following samples but high in nodularity for the first iron through the mold. Therefore, the alloy in tests 7–10 is unacceptable for making CG iron in the mold and the alloy of the invention used in tests 11–14 can provide CG iron with proper mold design.

TABLE II

| | | Alloys Tested in Window Molds (2550° F.) | | | | | | | | | | |
|---|---|---|---|---|---|---|---|---|---|---|---|---|
| | | Alloy Composition* | | | | | | Chamber | Alloy | Dissolution | Nodularity (%) | |
| Test No. | Alloy No. | Mg (%) | Ca (%) | Ti (%) | Al (%) | Ce (%) | Si (%) | Volume (cc) | Weight (g) | Time (sec) | 1st Sample | (Average) 2nd and Remaining Samples |
| 1 | 171 | 1.76 | 0.06 | 14.95 | ~0.30 | 0.07 | 49.08 | 110 | 231 | 17.0 | 12 | 14 |
| 2 | 172 | 1.77 | 0.05 | 14.54 | ~0.30 | 0.09 | 71.98 | 110 | 174 | 13.0 | 15 | 23 |
| 3 | 201 | 2.09 | 0.12 | 14.70 | 0.42 | 1.13 | 50.99 | 110 | 228 | 12.7 | 11 | 9 |
| 4 | 181 | 2.57 | 0.30 | 14.48 | 1.16 | 1.02 | 51.13 | 110 | 218 | 11.6 | 20 | 7 |
| 5 | 200 | 1.95 | 0.60 | 14.60 | 0.38 | 0.14 | 52.12 | 110 | 224 | >24.2 | 80 Gray 10 Nod - 10 CG | Gray |
| 6 | 215 | 2.15 | 1.10 | 14.23 | 1.36 | 2.14 | 51.55 | 110 | 212 | >26.5 | 65 | Gray |
| 7 | 319 | 3.48 | 0.29 | 9.61 | ~1.0 | 0.37 | 45.26 | 110 | 237 | 17.0 | 85 | 80 |
| 8 | 319 | | | | | | | 80 | 175 | | 85 | 80 |
| 9 | 319 | | | | | | | 65 | 144 | | 75 | Gray |
| 10 | 319 | | | | | | | 55 | 120 | | 80 | Gray |
| 11 | 218 | 2.71 | 0.21 | 12.20 | 1.12 | 0.21 | 51.18 | 110 | 221 | 14.5 | 70 | 60 |
| 12 | 218 | | | | | | | 90 | 171 | | 55 | 19 |
| 13 | 218 | | | | | | | 70 | 136 | | 50 | 15 |
| 14 | 218 | | | | | | | 50 | 97 | | 11 | Gray |

*Iron assumed as balance.

EXAMPLE II

The purpose of this example was to determine the efficiency of an alloy of the present invention in casting manifolds for V6 internal combustion engines of compacted graphite iron by the inmold process. Exhaust manifolds contain thin sections which are extremely difficult to make in the compacted graphite structure.

This manifold was normally made from ductile iron and the same molds were used as were normally used for ductile iron. The mold is horizontally parted with two inmold reaction chambers per mold and two manifolds per chamber for a total of four manifolds. Each chamber had a volume of 7.1 $in^3$ and a cross-sectional area of 6.7 $in^2$, and the mold has a poured weight of 93 lbs (204.6 kg.).

The alloy placed in the reaction chambers had the composition given in Table III below.

TABLE III

| Element | Weight Percent |
|---|---|
| Magnesium | 1.76 |
| Calcium | 0.06 |
| Titanium | 14.95 |
| Aluminum | 0.30 |
| Cerium | 0.07 |
| Silicon | 49.08 |

Molten iron containing 3.89% carbon, 1.94% silicon, 0.42% manganese and 0.013% sulfur was poured at 2640° F. (1449° C.) into the mold containing 230 g. of the alloy of Table III in each raction chamber. Pouring time was 6.6 seconds. Ultrasonic velocity measurements on the four manifolds averaged 0.2100 in/μsec on the heavy sections, approximately 0.6 inches (1.52 cm) thick. This average value denotes a compacted graphite structure as all readings were within the compacted graphite range. Ultrasonic velocity measurements on thin sections, approximately 0.17 inches (0.43 cm) thick, average 0.2159 in/μsec indicating higher nodularity in the thin sections.

Molten iron containing 3.70% carbon, 2.02% silicon, 0.42% manganese and 0.010% sulfur was poured at 2630° F. (1443° C.) into a mold containing 165 g. of alloy in each reaction chamber. A $\frac{5}{8}$ in. (1.59 cm) thick core was placed in each reaction chamber to decrease the surface area of the chamber from 6.7 $in^2$ as previously used in this example to 5.1 $in^2$ for this test. Pouring time was 6.3 seconds. Ultrasonic velocity measurements on the manifold averaged 0.2094 in/μsec for the 0.6 inch (1.59 cm) thick sections and 0.2049 in/μsec for the 0.17 inch (0.43 cm) thick sections. These readings show the compacted graphite structure. One of the four manifolds was sectioned in nine places—six places at about 0.6 inch (1.59 cm) thick section size and three places at about 0.17 inch (0.43 cm) section size. The microstructure of all nine samples was predominantly compacted graphite iron with the heavy sections at 90% compacted graphite, 10% nodular graphite and the thin sections at 80% compacted graphite and 20% nodular graphite. A chemical analysis sample from the same manifold was found to contain 2.36% silicon, 0.013% magnesium and 0.11% titanium.

EXAMPLE III

The alloy of Table IV below was obtained by plunging magnesium into molten titanium ferrosilicon.

TABLE IV

| Element | Weight Percent |
|---|---|
| Magnesium | 2.04 |
| Titanium | 14.41 |
| Rare Earth* | 0.13 |
| Calcium | 0.09 |
| Aluminum | 0.30 |
| Silicon | 52.10 |
| Iron | Balance |

*Predominantly cerium

The mold used was a 4 cylinder exhaust manifold and consisted of one manifold and associated gating. The reaction chamber was located beneath the pouring basin, and is designed to hold the molten iron in a so-called "bathtub" until a metal disc melts through allowing the metal to flow from the bathtub into the mold. This is called the Kockums process, which is a variation of the inmold process.

The reaction chamber in the tests was $2\frac{3}{4}$" (7.0 cm) in diameter. The amount of alloy added to the reaction chamber was varied from 0 to 400 grams. The optimum amount of alloy was 250 grams but compacted graphite iron was obtained from 200 to 400 grams (see Table V).

TABLE V

Properties of CG Iron Castings Made by the Kockums Process
$2\frac{3}{4}$" Diameter Chamber, S in Iron = .016-.018%,
Pouring Temperature = 2540° F. (1393° C.)

| Weight of Alloy Table IV (grams) | CHEMICAL COMPOSITION OF IRON CASTINGS Silicon (%) | Magnesium (%) | Titanium (%) | HEAVY SECTION (.6") Nodularity* (%) | Ultrasonic Velocity (in/μ sec) | THIN SECTION Nodularity* (%) |
|---|---|---|---|---|---|---|
| 0 | 2.02 | .010 | .02 | 100 | — | 100 gray |
| 200 | 2.56 | .015 | .11 | 10 | .1991 | 20 |
| 250 | 2.71 | .017 | .13 | 15 | .2019 | 20 |
| 300 | 2.80 | .021 | .17 | 11 | .2015 | 20 |
| 350 | 2.81 | .025 | .22 | 35 | .2048 | 15 |
| 400 | 2.92 | .027 | .25 | 10 | .2047 | 25 |

*Balance of structure is compacted graphite iron.

We claim:

1. A magnesium ferrosilicon alloy particularly suitable for producing compacted graphite cast iron in the inmold process comprising from about 1.5 to about 3.0 percent magnesium, from about 10 to about 20 percent titanium, from about 40 to about 80 percent silicon, up to about 2 percent rare earth, up to about 0.5 percent calcium, up to about 2 percent aluminum, and balance iron, said percentages being by weight based on the total weight of said alloy, the weight ratio of titanium to magnesium being from about 4:1 to about 12:1.

2. An alloy according to claim 1 comprising from about 1.75 to about 2.25 percent magnesium, from about 14 to about 16 percent titanium, about 50 percent silicon, about 0.1 to about 0.5 percent rare earth, predominantely cerium, less than about 0.2 percent calcium, about 0.4 percent aluminum, and balance iron, and the weight ratio of titanium to magnesium being about 7.5:1.

3. In a process for the production of compacted graphite iron castings in which molten carbon-containing iron is introduced to a mold by way of a mold inlet and travels to a mold cavity by way of a gating system which includes at least one intermediate chamber containing a magnesium ferrosilicon alloy in an amount to convert flake graphite to compacted graphite, the improvement in which said alloy comprises from about 1.5 to about 3.0 percent magnesium, from about 10 to about 20 percent titanium, from about 40 to about 80 percent silicon, up to about 2 percent rare earth, up to about 0.5 percent calcium, up to about 2 percent aluminum, and balance iron, said percentages being by weight based on the total weight of said alloy, and the weight ratio of titanium to magnesium being from about 4:1 to about 12:1.

4. The process according to claim 3 in which said alloy comprises from about 1.75 to about 2.25 percent magnesium, from about 14 to about 16 percent titanium, about 50 percent silicon, about 0.1 to about 0.5 percent rare earth, predominately cerium, less than about 0.2 percent calcium, about 0.4 percent aluminum, and balance iron, and the weight ratio of titanium to magnesium is about 7.5:1.

* * * * *

UNITED STATES PATENT AND TRADEMARK OFFICE

CERTIFICATE OF CORRECTION

PATENT NO. : 4,568,388

DATED : February 4, 1986

INVENTOR(S) : Charles E. Dremann and Thomas F. Fugiel

It is certified that error appears in the above-identified patent and that said Letters Patent are hereby corrected as shown below:

Cover page, Item /73/ should read:

--[73] Assignee: SKW Alloys, Inc.,
Niagra Falls, N.Y.--

Signed and Sealed this

Twenty-first Day of April, 1987

*Attest:*

DONALD J. QUIGG

*Attesting Officer*

*Commissioner of Patents and Trademarks*